US006897246B2

(12) United States Patent
Espinoza et al.

(10) Patent No.: US 6,897,246 B2
(45) Date of Patent: May 24, 2005

(54) RECYCLING LIGHT OLEFINS IN MULTISTAGE FISCHER TROPSCH PROCESSES

(75) Inventors: Rafael L. Espinoza, Ponca City, OK (US); Ajoy P. Raje, Stillwater, OK (US); Doug S. Jack, Ponca City, OK (US)

(73) Assignee: ConocoPhillips Company, Houston, TX (US)

( * ) Notice: Subject to any disclaimer, the term of this patent is extended or adjusted under 35 U.S.C. 154(b) by 171 days.

(21) Appl. No.: 10/293,525

(22) Filed: Nov. 12, 2002

(65) Prior Publication Data

US 2004/0092609 A1 May 13, 2004

(51) Int. Cl.[7] ..... C07C 27/00

(52) U.S. Cl. ..... 518/705; 518/700; 518/706; 518/707; 518/715

(58) Field of Search ..... 518/700, 705, 518/706, 707, 715

(56) References Cited

U.S. PATENT DOCUMENTS

| | | | |
|---|---|---|---|
| 4,754,092 A | 6/1988 | Iglesia et al. | 585/469 |
| 5,348,982 A | 9/1994 | Herbolzheimer et al. | 518/700 |
| 5,961,933 A | 10/1999 | Casanave et al. | 422/211 |
| 6,060,524 A | 5/2000 | Casanave et al. | 518/706 |

OTHER PUBLICATIONS

Article entitled "*Fundamentals and selection of advanced Fischer–Tropsch reactors*", by S.T. Sie et al., Elsevier; Applied Catalysis A: General 186, pp. 55–70, 1999.

Article entitled "*Intrinsic Kinetics of the Fischer–Tropsch Synthesis on a cobalt catalyst* ", by Ian C. Yates et al., The American Chemical Society, Energy and Fuels 1991, 5, pp. 168–173, Nov. 5, 1990.

Dry, *The Fischer–Tropsch Process: 1950–2000*, Catalysis Today 71 (2002) 227–241.

Snel et al., *Secondary reactions of primary products of the Fischer–Tropsch synthesis. Part I. The role of ethene*, J. Mol. Catal. (1987). 43(2), 237–47.

Snel et al., *Secondary reactions of primary products of the Fischer–Tropsch synthesis. Part II. The role of propene*, J. Mol. Catal. (1989). 54(1), 103–17.

Snel et al., *Secondary reactions of primary products of the Fischer–Tropsch synthesis. Part III. The role of butene*, J. Mol. Catal. (1989). 54(1), 119–30.

Snel et al., *Repression of methane formation in the catalytic hydrogenation of carbon monoxide under realistic conditions* $C_1$ Mol. Chem. (1986) vol. 1, pp. 349–353.

Snel et al., *Fischer–Tropsch Synthesis on iron–based catalysts:the effect of co–feeding small oxygenates*, Journal of Molecular Catalysis (1989) vol. 54, pp. 213–223.

*Primary Examiner*—J. Parsa
(74) *Attorney, Agent, or Firm*—Conley Rose P.C.

(57) ABSTRACT

A process for reducing $C_2$–$C_9$ olefin formation by recycling them to a Fischer-Tropsch hydrocarbon synthesis process and promoting recycled olefins chain growth comprises contacting a gas feed comprising a mixture of $H_2$ and CO with a catalyst in a reactor system at conditions effective to produce a hydrocarbon product stream including $C_2$–$C_9$ olefins, separating a $C_2$–$C_9$ olefins-rich stream from the hydrocarbon product stream to form a light olefin recycle stream and recycling the light olefin recycle stream to the reactor system at a point in the reactor system where the $H_2$:CO ratio is low relative to the $H_2$:CO ratio in the rest of the reactor system. Depending on whether the initial $H_2$:CO ratio is greater or less than the usage ratio of the selected catalyst, the recycled olefins can be returned to the system up- or downstream of the reactor system.

39 Claims, 3 Drawing Sheets

RECYCLING LIGHT OLEFINS IN MULTISTAGE FISCHER TROPSCH PROCESSES

CROSS-REFERENCE TO RELATED APPLICATIONS

Not applicable.

STATEMENT REGARDING FEDERALLY SPONSORED RESEARCH OR DEVELOPMENT

Not applicable.

TECHNICAL FIELD OF THE INVENTION

The present invention relates to a process for the preparation of hydrocarbons from synthesis gas, i.e., a mixture of carbon monoxide and hydrogen, typically labeled the Fischer-Tropsch process. More particularly, this invention relates to a method for configuring and operating multiple Fischer-Tropsch reactors so as to maximize the production rate and/or reduce the reactor volume in a Fischer-Tropsch reactor system.

BACKGROUND OF THE INVENTION

Natural gas, found in deposits in the earth, is an abundant energy resource. For example, natural gas commonly serves as a fuel or power generation and as a fuel for domestic cooking. The process of obtaining natural gas from an earth formation containing typically including drilling a well into the formation. Wells that provide natural gas are often remote from locations with a demand for the consumption of the natural gas.

Thus, natural gas is conventionally transported large distances from the wellhead to commercial destinations in pipelines. This transportation presents technological challenges due in part to the large volume occupied by a gas. Therefore, the process of transporting natural gas typically includes chilling and/or pressurizing the natural gas in order to liquefy it. However, this contributes to the cost of the natural gas and is not economical.

Further, naturally occurring sources of crude oil used for liquid fuels such as gasoline, jet fuel, kerosene, and diesel fuel have been decreasing and supplies are not expected to meet demand in the coming years. Fuels that are liquid under standard atmospheric conditions have the advantage that in addition to their value, they can be transported more easily in a pipeline than natural gas, since they do not require liquefaction.

Thus, for all of the above-described reasons, there has been interest in developing technologies for converting natural gas to more readily transportable liquid fuels. One method for converting natural gas to liquid fuels involves two sequential chemical transformations. In the first transformation, natural gas or methane, the major chemical component of natural gas, is converted into a mixture of carbon monoxide and hydrogen (i.e., synthesis gas or syngas). In the second transformation, known as the Fischer-Tropsch process, carbon monoxide (CO) reacts with hydrogen ($H_2$) to form organic molecules containing carbon and hydrogen. Those molecules containing only carbon and hydrogen are known as hydrocarbons. Hydrocarbons having carbons linked in a straight chain are known as aliphatic and could be saturated (paraffins) or unsaturated (olefins). Paraffins are particularly desirable as the basis of synthetic diesel fuel. In addition other products containing oxygen, hydrogen and carbon such as oxygenated hydrocarbons are formed.

The Fischer-Tropsch process is commonly facilitated by a catalyst. Catalysts have the desirable function of increasing the rate of a reaction without being consumed by the reaction. Common catalysts for use in the Fischer-Tropsch process contain at least one metal from Groups 8, 9, or 10 of the Periodic Table. The metal in the catalyst tends to facilitate reaction by forming temporary bonds with both carbon monoxide and hydrogen, thus bring carbon monoxide molecules into physical proximity with hydrogen molecules. The molecules react to form hydrocarbons while confined on the surface of the catalyst. The hydrocarbon products then desorb from the catalyst and can be collected.

Typically, the Fischer-Tropsch product stream contains hydrocarbons having a range of numbers of carbon atoms, and thus having a range of weights. Thus, the products produced by a Fischer-Tropsch synthesis contain a range of hydrocarbons that can include gas, liquids and even waxes. Hydrocarbon waxes can be hydrocracked to produce lighter liquids and/or gases. For example, a method of producing diesel fuel may include distillation to separate wax fractions from lighter hydrocarbons, hydrocracking of the wax fraction, and further distillation of the hydrocracking products to separate the diesel fraction of the hydrocracking products.

Originally, Fischer-Tropsch synthesis was carried out in packed bed reactors. These reactors have several drawbacks, such as difficulty of temperature control, that can be overcome by gas-agitated slurry reactors or slurry bubble column reactors. Gas-agitated multiphase reactors, sometimes called "slurry reactors" or "slurry bubble columns," are well known in the art. In a gas-agitated multiphase reactors, catalytic particles are suspended in liquid and gas reactants are fed into the bottom of the reactor through a gas distributor, which produces gas bubbles. As the gas bubbles rise through the reactor, the reactants are absorbed into the liquid and diffuse to the catalyst where, depending on the catalyst system, they are converted to gaseous and liquid products. The gaseous products formed enter the gas bubbles and are collected at the top of the reactor. The liquid products are recovered from the suspending liquid using any suitable technique, such as settling, filtration, magnetic separation, hydrocycloning, or the like, and then further separating the fluids.

Gas-agitated multiphase reactors or slurry bubble column reactors inherently have very high heat transfer rates; therefore, reduced reactor cost. The ability to remove and add catalyst online is one of the principal advantages of such reactors in Fischer-Tropsch synthesis, which is exothermic. Sie and Krishna (Appl. Catalysis A: General, (1999) 186 55–70) give a history of the development of various Fischer Tropsch reactors and the advantages of slurry bubble columns over fixed bed reactors Additionally it is well known that a Fischer-Tropsch reactor system can comprise a single stage or multiple stages, and can comprise a single reactor vessel or multiple reactor vessels per stage. In the case of a multistage reactor system, a stage may sometimes be defined as a "pass." A per-pass conversion, for example, represents the conversion obtained after one stage.

Yates and Satterfield (Energy and Fuels, (1991) 5, 168–173), provide an equation that, when combined with the hydrodynamics and mass transfer predictions, can be used to evaluate the performance of slurry bed reactor using cobalt catalysts. In its full form, that equation is given by Equation (1).

$$\text{Rate (CO hydrogenation)} = Ae^{-E/RT}(P_{H_2} \cdot P_{CO})/(1+a\,P_{CO})^2 \qquad (1)$$

where A is the intrinsic rate, E is the activation energy, R is the gas constant, T is the temperature (° K), and $P_{H_2}$ and $P_{CO}$ are the partial pressures of $H_2$ and CO, respectively. In practical applications, when the partial pressure of CO is greater than about 0.5 Bar, Equation (1) can be simplified to Equation (2):

$$\text{Rate} \propto P_{H_2}/P_{CO} \quad (2)$$

indicating that the rate of hydrogenation in a FT reactor is a function of the ratio of the concentration of $H_2$ to the concentration of CO, sometimes hereinafter referred to as the $H_2$:CO ratio.

Since the rate of conversion of $H_2$ can be different from that of CO, the exit $H_2$:CO ratio at the exit of the reactor where the reaction takes place can be lower or higher than the initial $H_2$:CO ratio at the inlet of that reactor, depending on whether the initial $H_2$:CO ratio is lower or higher than the $H_2$:CO usage ratio. Marc Dry in *Catalysis Today* 71, (2002) 228–229 defines the usage ratio for cobalt-based FT catalysts to be 2.15, whereas for iron-based FT catalysts, the usage ratio varies depending on the water-gas shift reaction which converts some of the CO to $CO_2$. The usage ratio for iron-based FT catalysts is typically lower than that of Co-based FT catalysts. As an example, the $H_2$:CO usage ratio is about 1.7 for the low-temperature FT process. When the initial $H_2$:CO ratio is lower or higher than the usage ratio, the conversion rate of $H_2$ is greater or lower, respectively, than that of CO. FIG. 1 illustrates the change in the exit $H_2$:CO ratio of a FT reactor with a cobalt-based catalyst for different conversions when the inlet $H_2$:CO ratio is below (▲), at (-·-), and above (□) the usage ratio of 2.15.

Hence, when the initial $H_2$:CO ratio to a Fisher-Tropsch reaction system is lower than the usage $H_2$:CO ratio, then the $H_2$:CO ratio will be even lower at the exit of the reactor, and consequently in the case of a multistage reactor system, the $H_2$:CO ratio will decrease with each successive pass through each reactor. One the other hand, when the initial $H_2$:CO ratio to a Fisher-Tropsch reaction system is higher than the usage $H_2$:CO ratio, the $H_2$:CO ratio will be even higher at the exit of the reactor, and consequently in the case of a multistage reactor system, the $H_2$:CO ratio will increase with each successive pass through each reactor. The usage $H_2$:CO ratio for any given catalyst is defined as the $H_2$:CO ratio which remains unchanged throughout the reactor regardless of conversion rate, i.e., the $H_2$:CO ratio in the feed to the reactor equals that of the exit of the reactor, due to identical conversion rate of $H_2$ and CO.

Considerable patent literature addresses the optimization of the Fischer Tropsch Slurry Bubble Column reactor (SBCR) and the overall system. U.S. Pat. No. 5,348,982 shows one mode of operation for SBCR. U.S. Pat. No. 6,060,524 and U.S. Pat. No. 5,961,933 shows that an improved operation can be obtained by introduction of liquid recirculation. U.S. Pat. No. 4,754,092 discloses a process for reducing methane formation and increasing liquid yields in Fischer-Tropsch hydrocarbon synthesis processes comprising adding one or more olefins to the reactor bed at a point below 10% of the distance from the top to the bottom of the reactor bed and above a point 10% above the bottom of the reactor bed to the top of the reactor bed in an amount sufficient to reduce said methane formation.

Despite all the development to date, there remains a need for an optimized Fischer Tropsch reactor and reactor configuration. In particular, there are continuing efforts to design reactors that are more effective at producing products in the desired range. In some instances it is particularly desirable to maximize the production of high-value liquid hydrocarbons, such as hydrocarbons with five or more carbon atoms per hydrocarbon chain ($C_{5+}$), and still more desirable to maximize the production of $C_{9+}$ hydrocarbons. Components ($C_{9+}$) that boil at temperatures above about 150° C., are herein defined as "heavy components" and are generally desirable, whereas $C_2$–$C_9$ are referred to herein as "light components." Furthermore, light olefins, i.e. unsaturated hydrocarbons having 2 to 9 carbons, are typically not desired products.

It is not uncommon, therefore, to recycle light olefins to a Fischer Tropsch reactor, with the expectation that they will undergo further chain growth, as illustrated in FIG. 2A. Because the recycled olefins can also undergo hydrogenation and form the corresponding paraffins, however, as shown in FIG. 2B, it is not possible to ensure that the olefins will undergo the desired chain growth. Furthermore, because the Fischer-Tropsch reaction is inherently a hydrogenation reaction, it is particularly difficult to achieve the desired chain growth.

Hence, it is desirable to design a gas-agitated multiphase reactor system that enhances the productivity of a Fischer-Tropsch system by increasing the degree of chain growth and minimizing the degree of hydrogenation that occurs in a recycled olefin stream. It is believed that increasing chain growth will in turn result in improved overall reactor productivity of $C_{9+}$ hydrocarbons and/or reduced reactor volume.

SUMMARY OF THE INVENTION

The present invention provides a method for operating a multiphase reactor system so as to enhance the productivity of a Fischer Tropsch system by increasing the degree of chain growth and minimizing the degree of hydrogenation of the recycled olefin stream in the reactor, which in turn enhances productivity of the $C_{9+}$ hydrocarbons and/or minimizes reactor volume. The invention is based in part on the inventors appreciation that, since the $H_2$ in the gas feed tends to be consumed at the higher rate than the CO, if the $H_2$ to CO ratio in the syngas feed is below the usage ratio (e.g. about 2.15 for cobalt-based catalysts) then the $H_2$ to CO ratio will decrease with each pass through a reactor or reactor system. A lower $H_2$ to CO ratio means that hydrogenation is less likely to occur. The present invention takes advantage of that reduced probability of hydrogenation to ensure that recycled light olefins are processed in a manner that is more effective in achieving the desired result, namely chain growth.

In accordance with one preferred embodiment, the present reactor system comprises at least two stages with a recycle. In order to take advantage of the varying $H_2$:CO ratios in the successive reactors or stages, one embodiment of the invention entails returning recycled olefins to the reactor system at a point where the $H_2$:CO ratio is lower than in other locations in the reactor system. In a particular embodiment, namely when the initial $H_2$:CO ratio in the syngas feed is below the usage ratio (e.g. less than about 2.15 for cobalt-based catalysts), the recycle is returned to the system at a point between the reactors and more preferably immediately upstream of the last reactor in the system. In contrast, when the initial $H_2$:CO ratio in the syngas feed is greater than the usage ratio (e.g. greater than about 2.15 for cobalt-based catalysts), because the ratio of $H_2$ to CO will increase throughout the system, the first reactor in the multistage system or the bottom portion of a reactor in any stage will contain the areas in which the $H_2$:CO ratios are lower than in other parts of the system. Hence, in another embodiment, the olefin recycle stream is returned more preferably immediately upstream of the first reactor in the system and/or in the bottom section of any reactor.

In another preferred embodiment, the system includes a feedback loop that determines the initial $H_2$ to CO ratio in the syngas feed, compares it to the (known) usage ratio, and selects the point at which the recycle olefins stream is returned to the system on the basis of that comparison. In still another preferred embodiment, the hydrogenation of recycled light olefins is minimized by returning the recycle stream to a single stage reactor at a point or points in the reactor where the $H_2$:CO ratio is low relative to the $H_2$:CO ratio in the rest of the reactor.

In a still further embodiment, light olefins are recycled into a reactor containing a catalyst having a lower hydrogenation activity than the catalyst(s) in the rest of the reactor system.

BRIEF DESCRIPTION OF THE DRAWINGS

For a more detailed description of the preferred embodiments of the present invention, reference will now be made to the accompanying Figures, wherein.

DETAILED DESCRIPTION OF THE PREFERRED EMBODIMENTS

In a first preferred embodiment of the present invention, a recycled light olefins stream is returned to a multistage FT reactor system or to a single FT reactor at a point that is selected to have a $H_2$:CO ratio that is low relative to the $H_2$:CO ratio in the rest of the reactor system or reactor.

Figure 1:
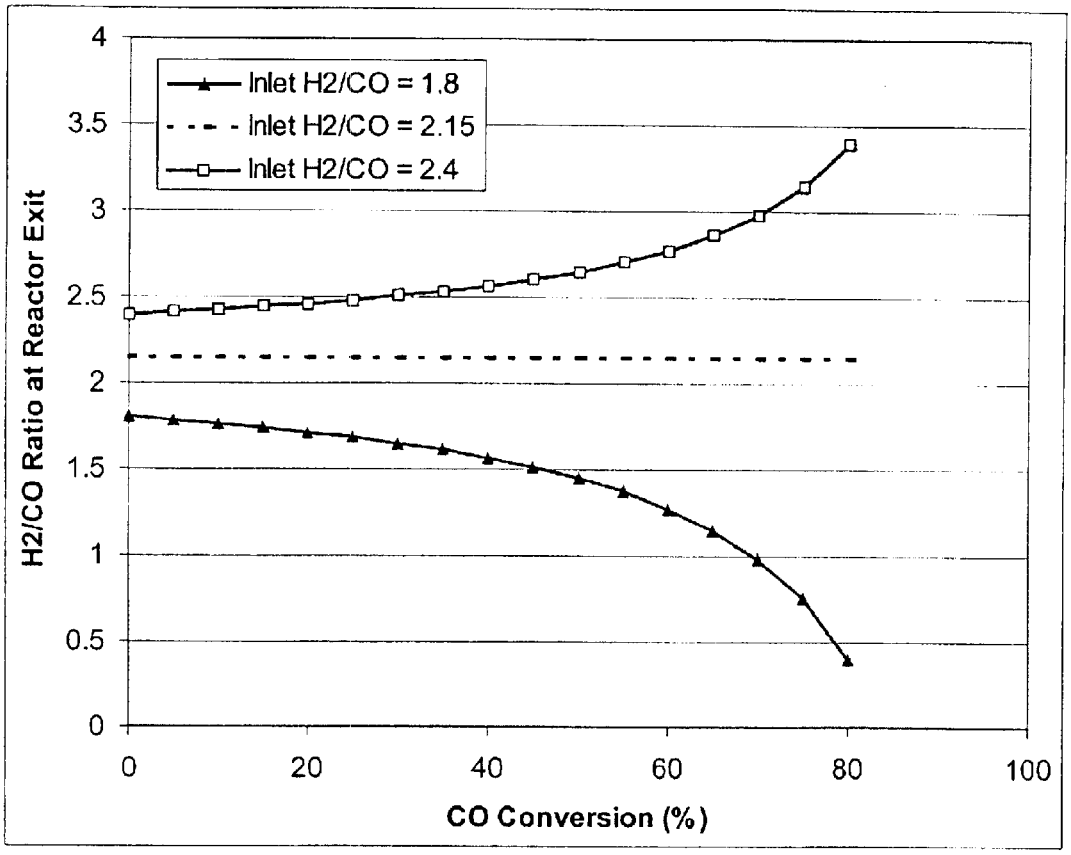
FIG. 1 is a plot illustrating the change in the exit $H_2$:CO ratio of a FT reactor with a cobalt-based catalyst for different conversions when the inlet $H_2$:CO ratio is below (▲), at (-·-), above (□) the usage ratio of 2.15.
Figure 2:
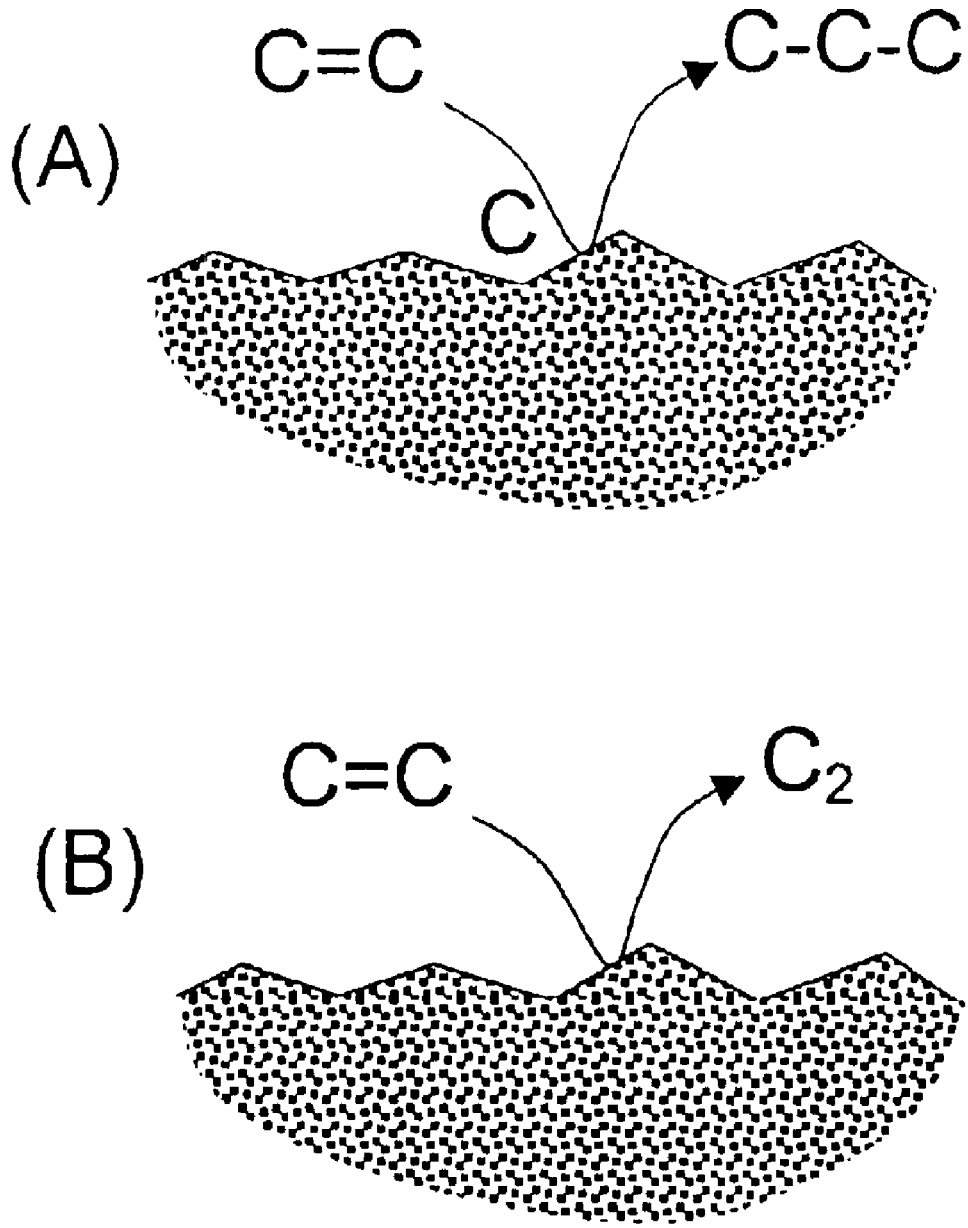
FIGS. 2A–B are schematic diagrams illustrating chain growth and hydrogenation, respectively.
Figure 3:
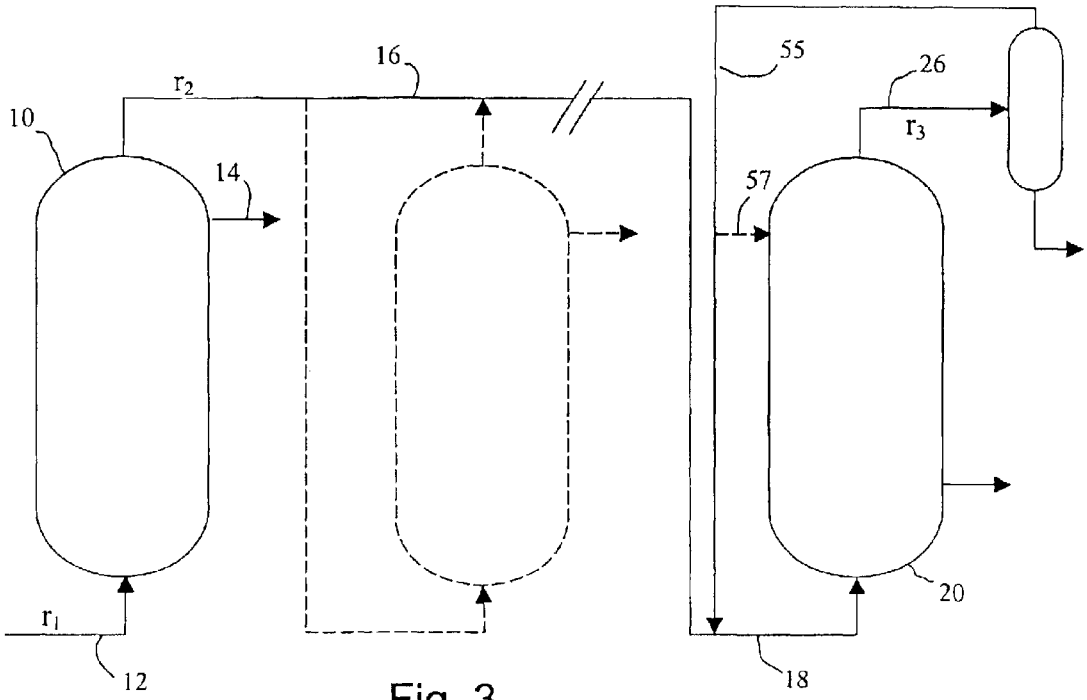
FIG. 3 is a schematic diagram of a multistage FT reactor system when the initial $H_2$:CO ratio is lower than the usage $H_2$:CO ratio in accordance with the present invention.

In multistage FT reactor systems, such as that shown in FIG. 3, a syngas stream 12 having a initial $H_2$:CO ratio $r_1$ is fed into a first reactor 10, in which the FT reaction takes place. In the embodiment shown, liquid products are removed from reactor 10 in an optional liquid stream 14 and a product stream 16. Alternatively, product stream 16 may be a multiphase stream, comprising various liquid and gaseous compounds, which can then be separated as desired. If desired, product stream 16 may be cooled or compressed in order to recover additional hydrocarbons from it and to knock out produced water. Product stream 16, comprising at least in part unreacted $H_2$ and CO, is then passed to and processed in optional additional reactors (shown in phantom), where another FT reaction takes place and produces one or more product streams analogous to those produced in reactor 10. Finally, a penultimate gas stream 18 is fed to a final reactor stage 20. The number and precise configuration of the reactors and intermediate processing equipment between them, including separation and water knock out equipment, can vary, as will be understood by those of ordinary skill in the art.

For an initial $H_2$ to CO ratio in the feed lower than the usage ratio, since the hydrogen in the feed gas tends to be consumed at a proportionally higher rate than the CO, the $H_2$:CO ratio decreases with each successive pass through a reactor, and absent a modification of the gas stream composition, the $H_2$:CO ratio $r_2$ of gas stream 16 entering the second reactor is less than $r_1$. Similarly, the $H_2$:CO ratio $r_3$ of the gas stream 26 leaving the last reactor is less than $r_2$.

For an initial $H_2$ to CO ratio in the feed higher than the usage ratio, the hydrogen in the feed gas will be consumed at a proportionally smaller rate than the CO and the $H_2$:CO ratio will increase with each successive pass through a reactor. Absent a modification of the gas stream composition, the $H_2$:CO ratio $r_2$ of gas stream 16 entering the second reactor will be greater than $r_1$. Similarly, the $H_2$:CO ratio $r_3$ of the gas stream 26 leaving the last reactor will be greater than $r_2$.

According to the preferred invention, in order to increase the chain growth of recycled light olefins and minimize their hydrogenation, the stream containing recycled light olefins is returned to the reactor systems at a point at which the $H_2$:CO ratio is lowest, or at least is low relative to other parts of the reactor system. In a multistage reactor system, when the $H_2$:CO ratio is lower than the usage $H_2$:CO ratio, the preferred return point may be immediately upstream of the last reactor. In the reactor system of FIG. 3, this is shown as recycle line 55. It will be understood that recycle line could be alternatively returned to the system at many other points, such as upstream of any intermediate reactor (shown in phantom), because the $H_2$:CO ratio at many points within the system is lower than the $H_2$:CO ratio of the feed stream $r_1$.

Alternatively or in addition, within a single slurry bed reactor such as are known in the art, it is preferred to return the recycled light olefin stream to the reactor at a point within the reactor where the $H_2$:CO ratio is low relative to other parts of that reactor. An exemplary reactor is shown at 100 in FIG. 4. This embodiment also represents the case for which the initial $H_2$:CO ratio is lower than the usage $H_2$:CO ratio. A feed gas stream enters reactor 100 via line 112 and a gaseous product stream is removed at 116. As above, liquid products are preferably removed at line 114. Because the feed gas enters reactor 100 at the bottom and passes upward through the reactor, and because $H_2$ is consumed slightly faster than CO, the $H_2$:CO ratio at the top of the expanded slurry bed will be lower than the $H_2$:CO ratio at the bottom of the bed. Therefore, according to the present invention, light olefins that are separated from the gaseous products are recycled to reactor 100 via a recycle line 155, which enters reactor 100 at or near the top of the slurry bed, particularly at points where the flow is downwards so as to allow thorough dispersion of the recycled stream into the slurry.

Furthermore, it is preferred to return the recycled light olefin stream to the reactor at a point where the concentration of water is high relative to other parts of the reactor. As disclosed in co-owned and co-pending application Ser. No. 60/344,228, filed Dec. 28, 2001 and entitled "Method For Reducing Water concentration in a Multi-Phase Column Reactor," which is incorporated herein by reference, it has been discovered that the water concentration near the outer wall of a reactor and in the upper half or one-third of the expanded slurry bed in the reactor is significantly higher than in other regions in the reactor. Even when the reactor is operated with significant back-mixing, the $H_2$ to CO ratio is typically lower at the top of the reactor. More specifically, if the expanded slurry bed is defined as having a height H and a radius R, the high water concentration tends to be located radially between approximately 0.5 R and R and vertically between approximately 0.5 H and H, in the region labeled 156. Still more specifically, the high water concentration is located between approximately 0.75 R and 0.875 R and vertically between approximately 0.75 H and H, in the region labeled 158. Thus, in accordance with the present invention, the light olefin recycle line 155 is returned to reactor 100 at a point preferably within region 156 and still more preferably within region 158. In this region, the flow direction is mainly downward, which further enhances the mixing of the recycled olefin-containing stream throughout the reactor slurry.

Figure 4:
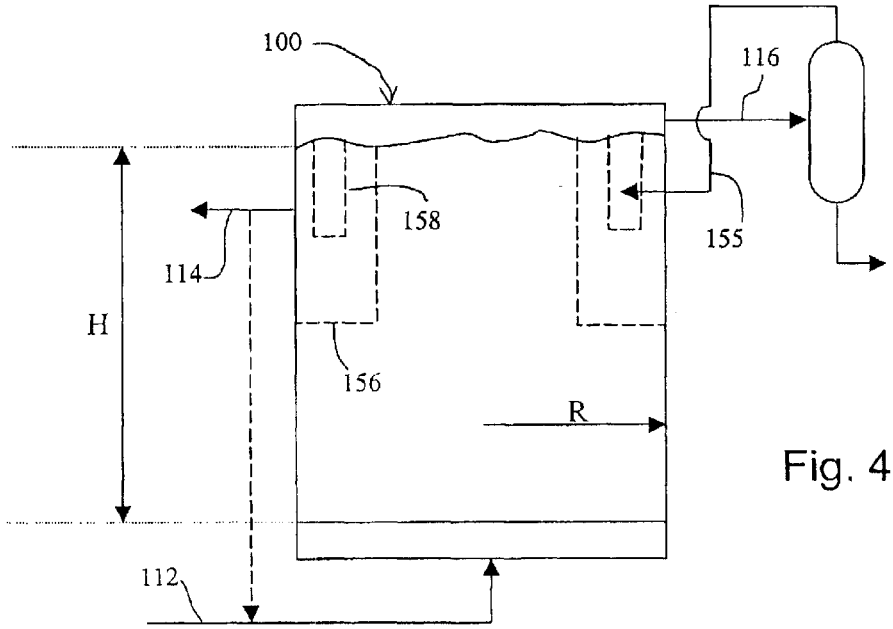
FIG. 4 is a schematic diagram of a single stage FT reactor system when the initial $H_2$:CO ratio is lower than the usage $H_2$:CO ratio in accordance with the present invention.

The concepts discussed with respect to FIG. 4 are equally applicable to the placement of the recycle line(s) in the context of the multistage system of FIG. 3. Thus, all or part of recycle stream 55 can be returned to reactor 20 via line 57 (shown in phantom in FIG. 3). In addition, the recycle stream can comprise gas or liquids and may be treated, i.e. compressed, expanded, heated, or cooled, as desired before being returned to a reactor, in order to optimize the chain growth of the recycled light olefins. In addition the recycle stream can be mixed with a feed line, as shown on feed line 18 in FIG. 3.

The foregoing principles can be applied even if all or some portion of the Fischer-Tropsch reaction is carried out in a fixed bed reactor. In many cases, the recycle stream is likely to be fed into the reactor only at a reactor inlet. In the case of a multi-stage reactor system incorporating a fixed bed reactor, the point of recycle return is still preferably at a point where the $H_2$/CO ratio is relatively low compared to other points in the reactor system; e.g. downstream of the inlet to the first stage when the initial $H_2$:CO ratio in the syngas feed is lower than the usage ratio and upstream of the inlet to the first stage when the initial $H_2$:CO ratio in the syngas feed is higher than the usage ratio. It should be also understood that the reactor system comprising a multistage reactor system can include at least one slurry bed reactor, or at least one fixed bed reactor, or any combination of both.

According to a still further embodiment of the invention, the rate of hydrogenation in successive reactors in a multi-stage reactor system is controlled or optimized to enhance the desired reduction in hydrogenation of light olefins by selecting a different catalyst for at least one reactor, and optionally for each successive reactor. Thus, in a preferred embodiment, when the initial $H_2$:CO ratio in the syngas feed is lower than the usage ratio and the catalyst system in the first reactor may be relatively active for hydrogenation, the catalyst systems in downstream reactors are selected to be less active for hydrogenation. In another embodiment, when the initial $H_2$:CO ratio in the syngas feed is higher than the usage ratio and the catalyst system in the last reactor may be relatively active for hydrogenation, the catalyst systems in upstream reactors are selected to be less active for hydrogenation. It is preferred that the catalyst in the reactor into which the recycle stream is returned have a lower hydrogenation activity relative to the catalysts in the other reactors.

Operation

In a preferred mode of operation, the Fischer-Tropsch reactor or reactors contain a desired catalytic material and are charged with feed gases comprising hydrogen or a hydrogen source and carbon monoxide. The catalytic material can be any suitable Fischer-Tropsch catalyst composition, such as are known in the art. The composition may, but does not necessarily, include iron, cobalt, ruthenium or a combinations thereof. Likewise, the catalytic material may optionally include a support and/or one or more promoters. The support is preferably an inorganic oxide material that can be optionally pretreated to enhance it mechanical strength and/or structure integrity. The pretreatment preferably comprises the addition of at least one chemical stabilizer. The catalytic material and can be prepared using any suitable technique, including but not limited to impregnation, chemical vapor deposition, precipitation and the like.

$H_2$/CO mixtures suitable as a feedstock for conversion to hydrocarbons according to the process of this invention can be obtained from light hydrocarbons such as methane by means of including but not limited to steam reforming, authothermal reforming or partial oxidation, and the like. The hydrogen is preferably provided by free hydrogen, although some Fischer-Tropsch catalysts have sufficient water gas shift activity to convert some water to hydrogen for use in the Fischer-Tropsch process. Similarly, the needed hydrogen can be produced in an associated steam reforming process. Thus, for example, the desired $H_2$:CO feed ratio can be obtained by running a steam reforming reaction in combination with a partial oxidation process. It is preferred that the mole ratio of hydrogen to carbon monoxide in the feed be greater than 0.5:1). The feed gas may also contain carbon dioxide. Alternatively, the feed gas may contain other compounds that are inert under Fischer-Tropsch reaction conditions, including but not limited to nitrogen, argon, or light hydrocarbons. The feed gas stream could contain a low concentration of compounds or elements that have a deleterious effect on the catalyst. The feed gas may need to be pretreated to ensure low concentrations of sulfur or nitrogen compounds such as hydrogen sulfide, ammonia and carbonyl sulfides.

The feed gas is contacted with the catalyst in a reaction zone in each reactor. Mechanical arrangements of conventional design may be employed as the reaction zone. The size of the catalyst particles may vary depending on the reactor in which they are to be used. Also, water partial pressure should be kept to a practical minimum. The water partial pressure is calculated as the mole fraction of water in the reactor outlet gas multiplied by the total outlet pressure of the reactor in a particular stage.

The Fischer-Tropsch process is typically run in a continuous mode. In this mode, the gas hourly space velocity through the reaction zone typically may range from about 50 $hr^{-1}$ to about 10,000 $hr^{-1}$, preferably from about 300 $hr^{-1}$ to about 2,000 $hr^{-1}$. The gas hourly space velocity is defined as the volume of reactants per time per reaction zone volume. The volume of reactant gases is as standard conditions of pressure (101 kPa) and temperature (0° C.). The reaction zone volume is defined by the portion of the reaction vessel volume where reaction takes place and which is occupied by a gaseous phase comprising reactants, products and/or inerts; a liquid phase comprising liquid/wax products and/or other liquids; and a solid phase comprising catalyst. The reaction zone temperature is typically in the range from about 160° C. to about 300° C. Preferably, the reaction zone is operated at conversion promoting conditions at temperatures from about 190° C. to about 260° C. The reaction zone pressure is typically in the range of about 80 psig (552 kPa) to about 1000 psig (6895 kPa), more preferably from 80 psig (552 kPa) to about 600 psig (4137 kPa), and still more preferably from about 140 psig (965 kPa) to about 500 psig (3447 kPa).

The reaction products will have a large range of molecular weights. The catalyst is preferably selected to produce hydrocarbons in the desired product range. When the syngas feed has a $H_2$:CO ratio that is lower than the usage ratio, the catalyst can be optionally designed such that catalyst used in the upstream end of the system is less active for hydrogenation than is the catalyst toward the downstream end. On the other hand, when the syngas feed has a $H_2$:CO ratio that is greater than the usage ratio, the catalyst can be optionally designed such that catalyst used in the downstream end of the system is less active for hydrogenation than is the catalyst toward the upstream end.

Irrespective of the $H_2$:CO ratios, it is desirable to return the olefins to the reactor system at a point where the hydrogenation activity is relatively low. In cases where the $H_2$:CO ratios are close to the stoichiometric ratio, the $H_2$:CO ratio will not change much along the reactor system and it is preferred to recycle the olefins at a point where the hydrogenation activity of the catalyst is relatively low.

The wide range of hydrocarbon species produced in the reaction zone often results in both liquid and gas phase products at the reaction zone operating conditions. Therefore, the effluent stream of the reaction zone will often be a mixed phase stream. The effluent stream of the reaction zone may be cooled to condense additional amounts of hydrocarbons and passed into a vapor-liquid separation zone. The vapor phase material may be passed into a second stage of cooling for removing part of the water from the system and for the recovery of additional hydrocarbons. The liquid phase material from the initial vapor-liquid separation zone together with any liquid from a subsequent separation zone may be fed into a fractionation column. Typically, a stripping column is employed first to remove light hydrocarbons such as propane and butane. The remaining hydrocarbons may be passed into a fractionation column wherein they are separated by boiling point range into products such as naphtha, kerosene and fuel oils. Hydrocarbons recovered from the reaction zone and having a boiling point above that of the desired products may be further processed into conventional upgrading equipment such as a hydrocracking zone in order to reduce their molecular weight. The olefins-containing stream recovered from the reaction zone and having a boiling point below that of the desired products is recycled totally or partially with or without further purification into the reactor or reactor system in the manner described above. The gas phase recovered from the reactor zone effluent stream after water separation and light hydrocarbon recovery may be passed to one or more downstream reactors or other system, and may be partially recycled to the same reactor.

Without further elaboration, it is believed that one skilled in the art can, using the description herein, utilize the present invention to its fullest extent. It will be understood that the invention has been described above with respect to the preferred embodiments, and that the configuration, rate, degree and components of the reactor systems disclosed herein can be modified without departing from the scope of the invention. It will further be understood that the recitation of steps in the claims is not intended to require that the steps be performed in a particular order, unless so stated, nor to require that a given step be completed before a subsequent step is begun, nor to preclude carrying out of the steps simultaneously.

What is claimed is:

1. A process for producing hydrocarbons from syngas having an initial $H_2$:CO ratio, comprising:

a) contacting the syngas with a catalyst in a reactor system at conditions effective to produce a hydrocarbon product stream that includes $C_2$–$C_9$ olefins, said catalyst having a $H_2$:CO usage ratio;

b) separating at least a portion of the $C_2$–$C_9$ olefins from the hydrocarbon product stream to form an olefin recycle stream;

c) determining whether the initial $H_2$:CO ratio is greater or less than a predetermined value and using information from said determination to select a recycle return location; and d) recycling the olefin recycle stream to the reactor system at the selected recycle return location.

2. The process according to claim 1 wherein said olefin recycle stream is further purified so as to increase the concentration of olefins in said olefin recycle stream.

3. The process according to claim 1 wherein the reactor system has a feed inlet, and the recycle return location is downstream of the feed inlet to the reactor system wherein the initial $H_2$:CO ratio is less than the predetermined value.

4. The process according to claim 3 wherein the reactor system comprises multiple stages and the recycle return location is in a syngas feed line to a reactor downstream of the first stage.

5. The process according to claim 3 wherein the reactor system comprises a multistage reactor system including at least a first and a last reactor and the recycle return location is between the first and the last reactor.

6. The process according to claim 1 wherein the recycle return location is upstream of the reactor system when the initial $H_2$:CO ratio is greater than the predetermined value.

7. The process according to claim 1 wherein the predetermined value is the catalyst $H_2$:CO usage ratio, further including returning the olefin recycle stream to the reactor system at a point that is upstream of the first stage when the initial $H_2$:CO ratio is greater than the usage ratio of $H_2$:CO in step a) and downstream of the first stage when the initial $H_2$:CO ratio is less than the usage ratio of $H_2$:CO in step a).

8. The process according to claim 1 wherein the predetermined value is 2.15:1.

9. The process according to claim 1 wherein the reactor system comprises multiple stages including at least a first and a last reactor, further including the step of providing a first catalyst in the first reactor and a last catalyst in the last reactor, wherein the first catalyst has a greater hydrogenation activity than the last catalyst.

10. The process according to claim 1 wherein the reactor system comprises multiple stages including at least a first and a last reactor, further including the step of providing a first catalyst in the first reactor and a last catalyst in the last reactor, wherein the first catalyst has less hydrogenation activity than the last catalyst.

11. The process according to claim 1 wherein the reactor system comprises a multistage reactor system, further including the step of removing water from the olefin recycle stream.

12. The process according to claim 1 wherein the reactor system comprises a multistage reactor system including at least one slurry bed reactor.

13. The process according to claim 1 wherein the reactor system comprises a multistage reactor system including at least one fixed bed reactor.

14. The process according to claim 1 wherein the reactor system comprises a multistage reactor system comprising at least two reactors.

15. The process according to claim 1 wherein the olefin recycle stream is a multiphase stream.

16. The process according to claim 1 wherein the reactor system comprises a slurry bed reactor in which a high water concentration zone is present during operation and the olefin recycle stream is returned to the reactor system in the high water concentration zone.

17. The process according to claim 1 wherein the reactor system comprises a slurry bed reactor having an expanded slurry bed and the olefin recycle stream is returned to the reactor system at at least one point positioned radially between 0.5 R and R, where R is the radius of the reactor, and vertically between approximately 0.5 H and H, where H is the height of the expanded slurry bed.

18. The process according to claim 1 wherein the reactor system comprises a slurry bed reactor having an expanded slurry bed and the olefin recycle stream is returned to the reactor system at at least one point positioned between approximately 0.75 R and 0.875 R, where R is the radius of the reactor, and vertically between approximately 0.75 H and H, where H is the height of the expanded slurry bed.

19. The process according to claim 1 wherein the catalyst comprises a catalytic metal selected from the group consisting of iron, cobalt, ruthenium and combinations thereof.

20. The process according to claim 19 wherein the catalytic metal is supported on an inorganic oxide support.

21. The process according to claim 20 wherein the inorganic oxide support is pretreated to enhance its mechanical strength or structural integrity.

22. The process according to claim 21 wherein the inorganic oxide support comprises a chemical stabilizer.

23. The process according to claim 19 wherein the catalytic metal is precipitated and mixed with at least one structural promoter and, optionally, at least one chemical promoter.

24. The process according to claim 1 wherein the catalyst comprises a promoter.

25. The process according to claim 1 wherein the catalyst is prepared by one or more methods selected from the group consisting of impregnation, chemical vapor deposition, precipitation, and combinations thereof.

26. A process for producing hydrocarbons from syngas having an initial $H_2$:CO ratio, comprising:

a) contacting the syngas with a catalyst in a reactor system at conditions effective to produce a hydrocarbon product stream that includes $C_2$–$C_9$ olefins, said catalyst having a $H_2$:CO usage ratio;

b) separating at least a portion of the $C_2$–$C_9$ olefins from the hydrocarbon product stream to form an olefin recycle stream; and c) recycling the olefin recycle stream to the reactor system at a point in the reactor system where the $H_2$:CO ratio is less than the initial $H_2$:CO ratio wherein the reactor system comprises at least two catalyst systems having different hydrogenation activities and the olefin recycle stream is returned to the reactor system at a point where the catalytic hydrogenation activity is relatively low.

27. A process for reducing $C_2$–$C_9$ olefin net production and promoting olefin chain growth in a Fischer-Tropsch hydrocarbon synthesis process, comprising:

a) contacting a gas feed comprising a mixture of $H_2$and CO and having an initial $H_2$:CO ratio with a catalyst in a reactor system having an $H_2$:CO usage ratio at conditions effective to produce a hydrocarbon product stream including $C_2$–$C_9$ olefins;

b) separating a $C_2$–$C_9$ olefins-containing stream from the hydrocarbon product stream to form an olefin recycle stream; and c) determining where in the reactor system the $H_2$:CO ratio will be low relative to the $H_2$:CO ratio at another point in the reactor system and recycling the olefin recycle stream to the reactor system at a point in the reactor system where the $H_2$:CO ratio is determined to be low relative to the $H_2$:CO ratio at another point in the reactor system.

28. The process according to claim 27 wherein the initial $H_2$:CO ratio is lower than the $H_2$:CO usage ratio and the contacting step is carried out in a multistage reactor system having at least a first stage and a last stage and the olefin recycle stream is returned to the reactor system downstream of the first stage.

29. The process according to claim 27 wherein the initial $H_2$:CO ratio is lower than the $H_2$:CO usage ratio and the contacting step is carried out in a slurry bed reactor and the olefin recycle stream is returned to the reactor at a point that is more than halfway up the slurry bed.

30. The process according to claim 27 wherein the initial $H_2$:CO ratio is higher than the $H_2$:CO usage ratio and the contacting step is carried out in a multistage reactor system having at least a first stage and a last stage and the olefin recycle stream is returned to the reactor system upstream of the first stage.

31. The process according to claim 27 wherein the initial $H_2$:CO ratio is higher than the $H_2$:CO usage ratio and the contacting step is carried out in a slurry bed reactor and the olefin recycle stream is returned to the reactor at a point that is less than halfway up the slurry bed.

32. The process according to claim 27, further including the step of determining whether the initial $H_2$:CO ratio is greater or less than the usage ratio of $H_2$:CO in step a) and returning the olefin recycle stream to the reactor system at a point that is upstream of the first stage when the initial $H_2$:CO ratio is greater than the usage ratio of $H_2$:CO in step a) and downstream of the first stage when the initial $H_2$:CO ratio is less than the usage ratio of $H_2$:CO in step a).

33. The process according to claim 27 wherein the catalyst includes cobalt.

34. The process according to claim 27, further including the step of determining whether the initial $H_2$:CO ratio is greater or less than a predetermined value and returning the olefin recycle stream to the reactor system at a point that is upstream of the first stage when the initial $H_2$:CO ratio is greater than said predetermined value and downstream of the first stage when the initial $H_2$:CO ratio is less than said predetermined value.

35. The process according to claim 34 wherein the predetermined value is 2.15:1.

36. A process for producing hydrocarbons comprising:

providing a feed stream having an initial $H_2$:CO ratio $r_1$;

reacting the feed stream in a first reaction zone so as to produce olefins and a first product stream having a second $H_2$:CO ratio $r_2$, $r_2$ being less than said initial ratio $r_1$;

selecting a point where the $H_2$:CO ratio is less than $r_2$ and recycling the olefins into the reaction zone at said point.

37. The process according to claim 36, further including reacting the first product stream in a second reaction zone so as to produce olefins and a second product stream having a second $H_2$:CO ratio $r_3$, $r_3$ being less than $r_2$, and recycling the olefins into the reaction zone at a point where the $H_2$:CO ratio is less than $r_2$.

38. A process for producing hydrocarbons comprising:

providing a feed stream having an initial $H_2$:CO ratio $r_1$;

reacting the feed stream in a first reaction zone so as to produce olefins and a first product stream having a second $H_2$CO ratio $r_2$, $r_2$ being greater than said initial ratio $r_1$;

selecting a point where the $H_2$:CO ratio is less than $r_2$ and recycling the olefins into the reaction zone at said point.

39. The process according to claim 38, further including reacting the first product stream in a second reaction zone so as to produce olefins and a second product stream having a second $H_2$:CO ratio $r_3$, $r_3$ being greater than $r_2$, and recycling the olefins into the reaction zone at a point where the $H_2$:CO ratio is less than $r_2$.

* * * * *